United States Patent [19]

Noguchi et al.

[11] 4,074,654

[45] Feb. 21, 1978

[54] AUTOMATIC CLOSURE CLEANSING AND COATING MACHINE

[75] Inventors: Yukihide Noguchi; Takeshi Nishimura; Jotaro Kishimoto; Yoshio Nishida, all of Osaka, Japan

[73] Assignee: Takeda Chemical Industries, Ltd., Osaka, Japan

[21] Appl. No.: 743,213

[22] Filed: Nov. 18, 1976

[30] Foreign Application Priority Data

Feb. 6, 1976 Japan ..... 51-12476

[51] Int. Cl.[2] ..... B05C 3/10; B08B 3/02

[52] U.S. Cl. ..... 118/73; 118/426; 134/62; 134/66; 134/79; 134/80

[58] Field of Search ..... 134/18, 21, 23, 25 A, 134/26, 33, 62, 66, 79, 80, 81; 15/302, 306 B; 118/73, 426

[56] References Cited

U.S. PATENT DOCUMENTS

| | | | |
|---|---|---|---|
| 2,730,068 | 1/1956 | Reynolds et al. | 134/66 X |
| 3,306,309 | 2/1967 | Pahl et al. | 15/306 B X |
| 3,311,500 | 3/1967 | Seto | 134/23 |
| 3,861,409 | 1/1975 | Taniguchi | 134/79 X |

*Primary Examiner*—Richard V. Fisher

*Attorney, Agent, or Firm*—Wenderoth, Lind & Ponack

[57] ABSTRACT

An automatic closure cleansing machine has at least two rotary carriers each having a plurality of receptacles arranged in equally spaced relation to each other and also in equally spaced relation to the axis of rotation of the corresponding rotary carrier, and first and second cleansing liquid applicators being positioned adjacent the rotary carriers, respectively, for spraying a cleansing liquid under pressure towards the closure members carried by the rotary carrier by the effect of a suction force. For this purpose, the receptacles on each rotary carrier are successively communicated to a source of vacuum. One of the opposed sides of each of the closure members is cleansed during the transportation of the closure member by the first rotary carrier while the other of the opposed sides of the closure member is cleansed during the transportation of the closure member by the second rotary carrier. A silicone resin coating may be applied to the closure members after they are removed from the second rotary carrier.

8 Claims, 7 Drawing Figures

AUTOMATIC CLOSURE CLEANSING AND COATING MACHINE

The present invention generally relates to an automatic closure cleansing machine and, more particularly, to an automatic closure cleansing machine for cleansing rubber closures of a definite shape for rigid or semirigid containers of a type having a neck or mouth adapted to be closed with the closure.

For cleansing closures for bottles such as vials, two methods have heretofore generally been practised. One method is the use of a rotary cleansing cylinder supported for rotation about its own longitudinal axis and filled with a continuously replenished cleansing liquid and the other method is the use of a cleansing cylinder having a rotary stirrer at the bottom thereof and filled with a continuously replenished cleansing liquid. In both methods, a batch of rubber closures are charged into the cylinder and, during rotation of the cylinder or the stirrer, these closures are tumbled so as to come into frictional contact with each other and also with the inner wall of the cylinder. The consequence is that foreign matters sticking or adhering to the closures are forced to separate from the closures and are in turn removed from the cylinder after having been entrained in an overflow of the cleansing liquid from the cylinder.

Since these conventional cleansing methods rely on friction taking place within the cleansing cylinder between the closures and also between the closures and the inner wall of the cylinder, substantially complete separation of the foreign matters is not easy if the closures being cleansed are of a type having a complicated shape, for example, of a type having a closure body formed on one surface thereof with an annular leg which is, when the closure is mounted on the neck or mouth of a bottle, tightly inserted into the neck or mouth. Moreover, uniform cleansing can hardly be achieved among the closures of the same batch, let alone in different batches of closures. In addition, there is a relatively great possibility that foreign matters once separated from the closures being cleansed tend to adhere or stick again to the closures without being removed from the cylinder.

Depending upon the purpose for which the closures are used in connection with the associated bottles, the closures after having been cleansed are required to be coated with a silicone resin. According to the prior art, this application of the silicone resin is carried out separately from the cleansing process, utilizing equipment independent of the cleansing cylinder and exclusively designed for performing the silicone resin application.

Accordingly, the present invention has been developed for providing an improved closure cleansing machine capable of automatically and individually cleansing the closures of a type having a closure body formed on one surface thereof with an outwardly projecting leg adapted to be tightly engaged in the mouth of a container, with substantial elimination of the disadvantages inherent in the conventional cleansing methods.

Another important object of the present invention is to provide an improved closure cleansing machine of the type referred to above capable of performing in sequence both cleansing and silicone coating processes.

It is to be noted that the automatic closure cleansing machine according to the present invention can satisfactorily operate with closures for containers, such as bottles of a type having a mouth adapted to be closed with the closure, said closures being of a type made of any known material and comprising a closure body of any suitable contour, having a flat, planar face on both sides of said closure body adjacent the periphery thereof, and a sealing leg of a cylindrical, or substantially cylindrical, configuration having one end integral with the closure body and outwardly extending from one of the opposite sides of the closure body, the outer diameter of said sealing leg at that end adjacent the closure body being such that the flat, planar face on said one of the opposite sides of the closure body is defined in the closure body externally of the sealing leg. A central, or substantially central, area of the closure body on which the machine according to the present invention can operate may protrude outwardly or inwardly and/or have one or more apertures or recesses extending halfway through the thickness of the closure body. Similarly, the sealing leg may be composed of a plurality of segments or may have one or more axially extending grooves and/or a circular or annular cross sectional shape and is adapted to either project into or surround the mouth of a bottle when said closure is used to close the opening of the bottle.

With the above in mind, according to the present invention, the automatic closure cleansing machine basically comprises first and second rotary carriers positioned adjacent to each other for rotation in the opposite directions about their respective axes of rotation and each having receptacles for the support of the closures, which receptacles are arranged in equally spaced relation to each other in at least one circular row coaxial with the axis of rotation of the rotary carrier, and first and second cleansing liquid applicators respectively positioned adjacent the first and second rotary carriers. The first rotary carrier is rotated in sequence past a supply station where closures to be cleansed are successively supplied to the receptacles in the first rotary carrier, a first cleansing station where the first cleansing liquid applicator is located, and a transfer station. The second rotary carrier is rotated similarly in sequence past the transfer station where the closures supplied to the associated receptacles in the first rotary carrier and transported by said first rotary carrier from the supply station towards the transfer station past the first cleansing station are transferred to one of the receptacles in the second rotary carrier, a second cleansing station where the second cleansing liquid applicator is located, and a release station where the closures successively transferred from the first rotary carrier at the transfer station and transported by the second rotary carrier past the second cleansing station from the transfer station are successively ejected from said second rotary carrier to a subsequent processing station, for example, towards any known capping machine or towards a silicone applicator.

For transporting the closures from the supply station towards the transfer station by means of the first rotary carrier, some of the receptacles in the first rotary carrier are successively communicated to a means for supplying a vacuum so that the closures can be held or supported in said some of the receptacles under suction. Similarly, for transporting the closures from the transfer station towards the release station by means of the second rotary carrier, some of the receptacles in the first rotary carrier are successively communicated to the means for supplying a vacuum so that the closures can be held or supported in said some of the receptacles under suction. At the transfer station and the release station, the respective receptacles in the first and second rotary carriers being rotated in the same direction in synchronism with each other may be communicated to either the atmosphere or a common means for supplying compressed air to facilitate successive transfer from the first rotary carrier onto the second rotary carrier and successive ejection from the second rotary carrier to the subsequent processing station.

During successive passage of the closures past the first cleansing station while they are transported by the first rotary carrier, one of the opposite sides of each of the closures is cleansed by cleansing liquid sprayed under pressure by the first cleansing liquid applicator. Similarly, during successive passage of the closures past the second cleansing station while they are transported by the second rotary carrier, the other of the opposite sides of each of the closures is cleansed by cleansing liquid sprayed under pressure by the second liquid applicator.

Each of the first and second rotary carriers may be composed of either a cylindrical drum, supported for rotation together with a transverse shaft extending horizontally or a disc supported for rotation together with an upright shaft extending vertically. Where each of the first and second rotary carriers is in the form of the cylindrical drum, the receptacles for the support of the closures to be cleansed are provided on the outer peripheral surface thereof while, where each of the first and second rotary carriers is in the form of the disc, the receptacles for the support of the closures to be cleansed are provided on one surface thereof adjacent the outer periphery thereof.

The number of rows of the receptacles in each of the first and second rotary carriers is not always limited to one, but may be two or more. Moreover, the number of the receptacles in one row on each rotary carrier depends upon the size of the rotary carrier and may be 4 to 40.

Each of the receptacles on any one of the rotary carriers may be in the form of a recess formed in the rotary carrier. In this case, however, there is the possibility that, since the pressure of a cleansing liquid applied from the cleansing liquid applicator to the closures being transported by the rotary carrier is so high and so directed that each closure may have a load of 18 to 20 $kg/cm^2$ imposed thereon by the sprayed cleansing liquid impinging thereupon, some or all of the closures moving past the cleansing station while supported by the associated receptacles will be separated from said associated receptacles in the rotary carrier by the splashing of cleansing liquid on the surface of the rotary carrier. In order to avoid this possibility, each of the receptacles in the first and second rotary carriers is preferably composed of a support column extending outwardly from the rotary carrier the free end of which has formed therein an inwardly extending recess or pocket complementary in shape to the shape of the sealing leg of the closures and has an outer diameter substantially equal to the diameter of the closure body of the closures. Since the support column advantageously provides a space between the closure on said support column and the surface of the rotary carrier from which said support column extends outwardly, the splashing of cleansing liquid from the surface of the rotary carrier can be decelerated thereby eliminating the above described possibility.

If desired, another set of third and fourth rotary carriers similar in construction to the first and second rotary carrier may be employed with the third rotary carrier positioned adjacent the second rotary carrier at the ejection station, which third and fourth rotary carriers constitute a silicone applicator for continuously applying a silicone resin coating to the individual closures which have been cleansed.

In any event, with the cleansing machine according to the present invention, the closures for the containers are individually and automatically cleansed in contrast to what is referred to as a "mass cleansing under a batch procedure" according to the above described conventional methods. Because of the above feature, the individual closures can efficiently and satisfactorily be cleansed with no substantial damage to the closures which may otherwise occur if they are brought into frictional engagement with each other according to the conventional cleansing methods. Moreover, the automated feature of the cleansing machine according to the present invention makes it possible to achieve a thorough automation of the bottling process which has heretofore required the intervention of physical labour between the closure cleansing step and the automatic bottle capping or sealing step.

In any event, these and other objects and features of the present invention will become apparent from the following description taken in conjunction with preferred embodiments thereof with reference to the accompanying drawings, in which.

Figure 4:
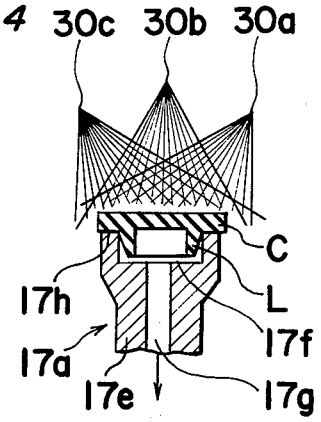
FIG. 4 is a view, corresponding to FIG. 3, showing the pattern of cleansing liquid sprayed onto the closure supported by one of support columns on the rotary drum.
Figure 5:
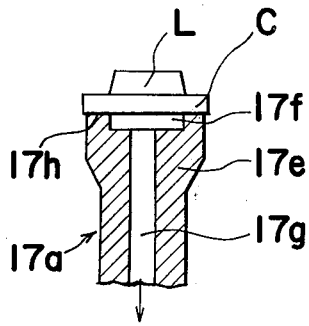
FIG. 5 is a view similar to FIG. 4, showing the closure supported by one of support columns on one of the rotary drums employed in the machine of FIG. 1.
Figure 6:
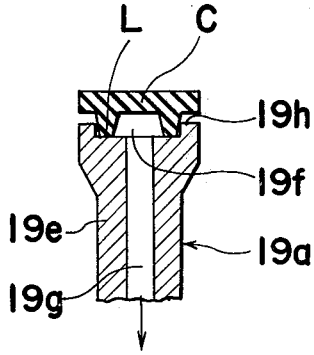
FIG. 6 is a view similar to FIG. 4, showing the closure supported by one of support columns on another one of the rotary drums employed in the machine of FIG. 1.

Before the description of the present invention proceeds, it is to be noted that like parts are designated by like reference numerals throughout the accompanying drawings. It is further to be noted that, although the automatic closure cleansing machine according to the present invention can satisfactorily operate with the closure members if each of these closure members has the construction which has already been referred to, the machine will, for facilitating a ready and better understanding of the present invention, be described as operable with the closure members for vials for containment of a medical injection solution, which closure members are generally referred to as plugs each comprising a closure body C of circular configuration having a cylindrical leg L of annular cross section integral with one side thereof and extending outwardly therefrom in coaxial relation to the center of the closure body C, the maximum outer diameter of said annular leg L being smaller than the diameter of the closure body C, as best shown in FIGS. 4 to 6.

Figure 1:
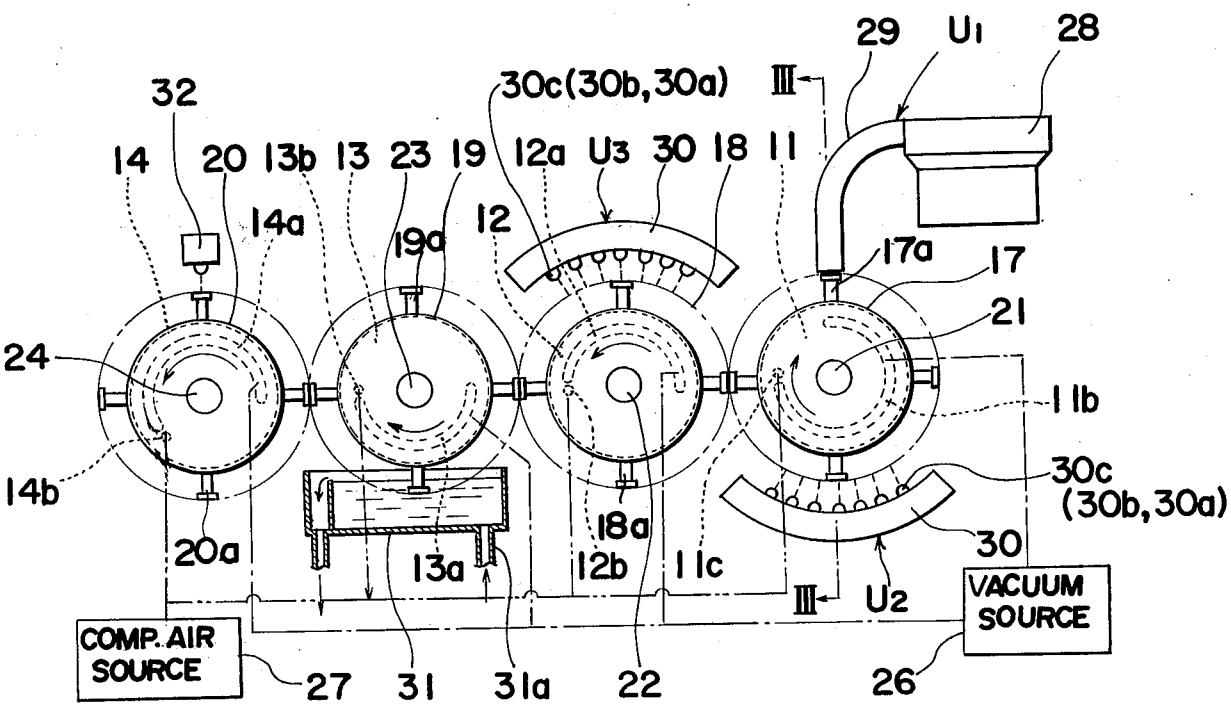
FIG. 1 is a schematic front elevational view, with a portion shown in section, of an automatic closure cleansing machine according to one preferred embodiment of the present invention.
Figure 2:
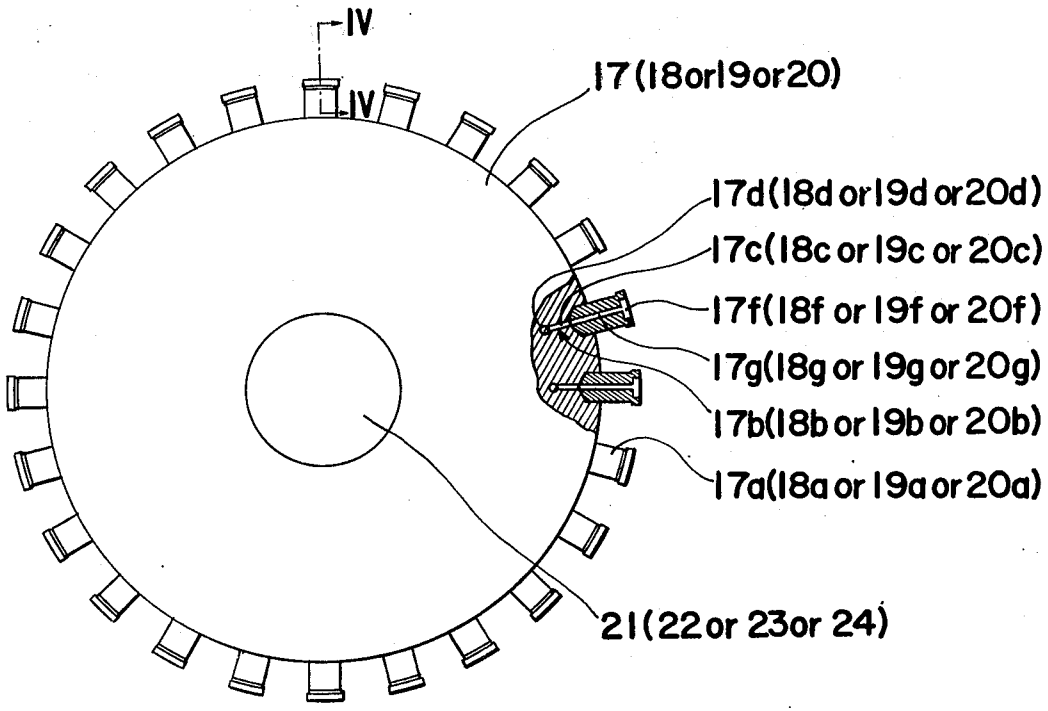
FIG. 2 is a front elevational view, with a portion broken away and on an enlarged scale, of one of the rotary drums employed in the machine of FIG. 1.
Figure 3:
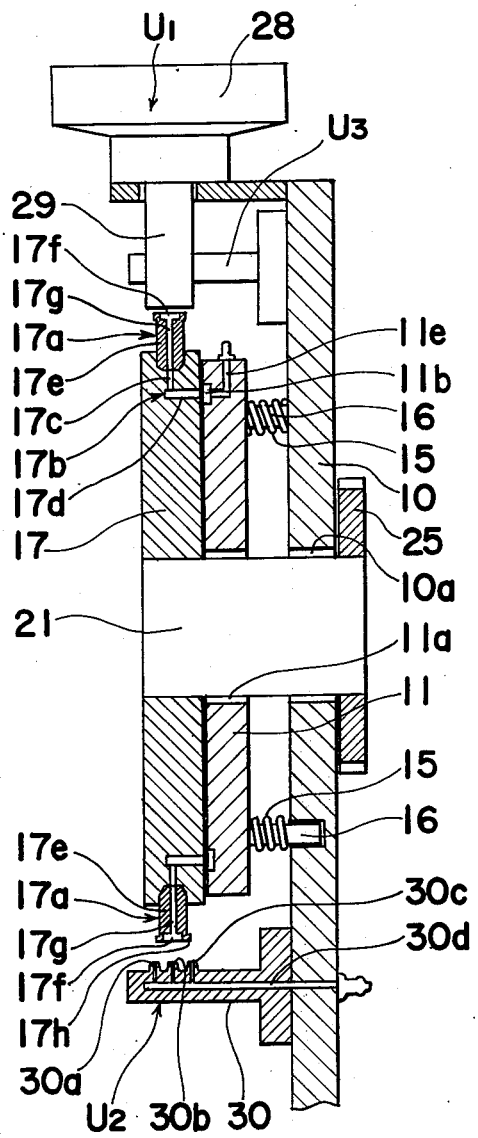
FIG. 3 is a cross sectional view, on an enlarged scale, taken along the line III—III in FIG. 1.

Referring now to FIGS. 1 to 3, the automatic closure cleansing machine according to one preferred embodiment of the present invention is shown to comprise a bench or machine framework (not shown) having an upright support 10 extending vertically from said bench and having therein four bearing openings in spaced relation to each other, only one of which opening is shown by 10*a* in FIG. 3. The upright support 10 is shown to carry annular presser plates 11, 12, 13 and 14, which may, however, be of one-piece construction, but are shown as separate members by the broken lines in FIG. 1. Each of these presser plates 11 to 14 has a hole therethrough and aligned with the respective bearing openings in the upright support 10, only one of said holes aligned with the bearing opening 10*a* being shown by 11*a* in FIG. 3. For a purpose which will become clear from the subsequent description, each of these presser plates 11 to 14 is biased in one direction away from the upright support 10 by the action of compression springs.

Although the number of compression springs for each presser plate may be one, two compression springs are shown generally by 15 for each presser plate in FIG. 3. The compression springs 15 of the pair for each presser plate 11, 12, 13 or 14 are mounted on a corresponding number of connecting rods 16 each of which rods has one end telescopically received by either the upright support 10 or associated presser plate 11, 12, 13 or 14 and the other end rigidly connected to the other of said upright support 10 and associated presser plate 11, 12, 13 or 14. As illustrated, said one end of the rod 15 is shown to be rigidly connected to the associated presser plate while said other end of the rod 15 is shown to be telescopically received by the upright support 10.

These presser plates 11 to 14 are respectively held in position between the upright support 10 and rotary drums 17, 18, 19 and 20 and yieldably biased towards said rotary drums 17 to 20, respectively, by the action of the compression springs 15. The first to fourth rotary drums 17 to 20 are respectively rigidly mounted on shafts 21, 22, 23 and 24, each of said shafts 21 to 24 having one end carrying the corresponding rotary drum 17, 18, 19 or 20 and the other end having a gear wheel (only the gear wheel associated with the shaft 21 being shown by 25 in FIG. 3), a substantially intermediate portion of said shaft rotatably extending the corresponding through hole in the presser plate and the corresponding bearing opening in the upright support 10. The gear wheels on the shafts 21 to 24 on the opposite end from the respective rotary drums 17 to 20, are engaged with each other while one of them is operatively coupled to a drive mechanism (not shown), for example, an electric motor, so that the first and third rotary drums 17 and 19 are rotated in the same direction, for example, clockwise as shown by the respective arrows in FIG. 1, while the second and fourth rotary drums 18 and 20 are rotated in the same direction, but in a direction, i.e., counterclockwise as shown by the respective arrows in FIG. 1, counter to the clockwise direction of rotation of the first and third rotary drums 17 and 19, all of these rotary drums 17 to 20 being, however, synchronized with each other.

Alternatively, each adjacent pair of these gear wheels may be engaged to each other through at least one pair of intermediate gears positioned between the gear wheels of each pair while one of the gear wheels and intermediate gears is operatively coupled to the drive mechanism. In any event, for rotating the first to fourth rotary drums 17 to 20 in the manner as hereinbefore described, any known suitable transmission, for example, an endless chain, may also be employed instead of the gear train. The drive mechanism may include, or may not include, a reduction gear assembly depending upon the size of the gear wheels and/or the type of drive mechanism.

In the construction so far described, it is clear that, during continued operation of the drive mechanism, the first and third rotary drums 17 and 19 are rotated clockwise in synchronism with each other and the second and fourth rotary drums 18 and 20 are rotated counterclockwise in synchronism with each other, the former pair of rotary drums 17 and 19 also being synchronized with the latter pair of rotary drums 18 and 20.

In the instance as shown, the rotary drums 17 to 20 have the same diameter and the same construction and, therefore, for the sake of brevity, only one of them, the rotary drum 17, will be now described in detail. Elements of each of the other rotary drums 18 to 20, not mentioned in the subsequent description, which correspond to the elements of the rotary drum 17, are designated by like alphabetic characters in combination with the reference numeral "18", "19" or "20".

The rotary drum 17 has on its outer peripheral surface a plurality of receptacles generally indicated by 17*a* and circumferentially arranged in at least one row and extending radially outwardly therefrom in equally spaced relation to each other and also to the axis of rotation of the rotary drum 17. The rotary drum 17 has therein a corresponding number of L-shaped passages 17*b* each having a radial passage portion 17*c* in communication with a corresponding one of the receptacles 17*a* and an axial passage portion 17*d* opening at one end face of the drum 17 which faces the corresponding presser plate 11. It should be noted that the axial passage portions 17*d* of the individual passages 17*b* in the rotary drum 17 are, therefore, arranged in a circular configuration equally spaced from the outer peripheral surface of said drum 17 or from the axis of rotation of the drum 17.

Each of the receptacles 17*a* is comprised of a cylindrical body 17*e* having one end rigidly tapped into, or otherwise integrally formed with or secured to, the rotary drum 17 and the other end having a radially inwardly extending circular recess 17*f* which is in communication with the radial passage portion 17*c* of the L-shaped passage 17*b* through a passage 17*g* formed in said cylindrical body 17*e*. It should be noted that, while the outer diameter of the cylindrical body 17*e* at said other end is preferably equal to the diameter of the closure body C of the plug as best shown in FIG. 4, the circular recess 17*f* has a bore size substantially equal to or slightly greater than the outer diameter of the annular leg L of the same plug and a depth substantially equal to or slightly greater than the height, i.e. the axial length, of said annular leg L. It is also to be noted that provision of the circular recess 17*f* in that end of the cylindrical body 17*e* leaves an annular end face as indicated by 17*h*.

While each of the first to fourth rotary drums 17 to 20 is constructed as hereinbefore described, for the purpose as will become clear later, it is preferred that the circular recesses 19*f* in the cylindrical bodies 19*e* of the associated receptacles 19*a* on at least the third rotary drum 19 have, as best shown in FIG. 6, a depth smaller than the height of the annular leg L of the plug and also the depth of the circular recesses in the respective receptacles 17*a*, 18*a* and 20*a* on the other rotary drums 17, 18 and 20, whereas the circular recesses 17*f* in the cylindrical bodies 17*e* of the associated receptacles 17*a* on the first rotary drum 17 must have a depth substantially equal to or slightly greater than the height of the annular leg L of the plug. The depth of the circular recesses 18*f* and 20*f* on the second and fourth rotary drums 18 and 20 may be equal to or different from, i.e., smaller or greater than, any one of the recesses 17*f* and 19*f* on the first and third rotary drums 17 and 19.

The L-shaped passages 17*b*, 18*b*, 19*b* and 20*b* in the respective rotary drums 17, 18, 19 and 20 are, during rotation of the rotary drums 17 to 20, selectively communicated to a common source of vacuum in the form of vacuum supplying means 26 and a source of compressed air in the form of air supplying means 27 in a manner as will be described later. For this purpose, the first presser plate 11 adjacent the first rotary drum 17 has in one surface thereof, which is held in sliding contact with the first rotary drum 17, a groove 11*b* and a recess 11*c*, both in alignment with the path of travel of openings of the respective axial passages portions 17*d* of the individual passage 17*b*.

Similarly, the second to fourth presser plates 12, 13 and 14 have in one surface thereof, which is held in sliding contact the adjacent rotary drum, with a groove 12*a*, 13*a* or 14*a* and a recess 12*b*, 13*b* or 14*b* both in alignment with the path of travel of openings of the respective axial passage portions 18*d*, 19*d* or 20*d* of the individual passages 18*a*, 19*a* or 20*a*.

The grooves 11*b*, 12*a*, 13*a* and 14*a* in the respective presser plates 11, 12, 13 and 14 are communicated with the vacuum source 26 by means of passages formed in the respective presser plates 11, 12, 13 and 14, only one of said passages in the presser plate 11 being shown by 11*e* in FIG. 3. The recesses 11*c*, 12*b*, 13*b* and 14*b* are communicated to the compressed air source 27 by means of passages formed in the respective presser plates 11, 12, 13 and 14 in a manner similar to said passage 11*e* in said presser plate 11. The details of relative positioning of these grooves 11*b*, 12*a*, 13*a* and 14*a* and recesses 11*c*, 12*b*, 13*b* and 14*b* will be described later.

The illustrated machine further comprises a closure supply unit $U_1$ including a closure feeder 28 and a chute 29 having one end coupled to the feeder 28 and the other end shown to be positioned above the first rotary drum 17 and in the vicinity of the annular face 17*h* of any of the receptacles 17*a* on the first rotary drum 17. The feeder 28 has a construction wherein a batch of plugs to be cleansed and charged thereinto are automatically aligned in such a manner that the plugs are successively forced to enter the chute 29 with the annular leg L facing towards the rotary drum 17. In any event, this supply unit $U_1$ may be of any known construction such as used in association with a conventional bottling and capping system and is commercially available, being sold by Kobe Steel Co., Ltd. of Japan under the trade name of "Shinko Parts Feeder, Model EB-1C". As illustrated, that end of the chute 29 opposed to the feeder 28 is positioned at a supply station where the plugs successively fed into the chute 29 from the feeder 28 in a predetermined posture with the annular leg L facing outwards are successively supplied into the corresponding receptacles 17*a* on the first rotary drum 17 during the continued rotation of the latter as will be described in more detail later. More specifically, that end of the chute 29 is shown to be positioned in the vicinity of the path of travel of the annular faces 17*h* of the respective receptacles 17*a* on the first rotary drum 17 and above and on the vertical line passing through the axis of the shaft 21 at right angles to said shaft 21.

Starting from the supply station, the rotary drum 17 is rotatable in sequence past a first cleansing station and a transfer station. The first cleansing station is shown to be positioned immediately below the rotary drum 17 and in substantially opposed relation to the supply station while the transfer station is spaced 90° from the first cleansing station and 270° from the supply station in the direction of rotation of the first rotary drum 17. At the first cleansing station, there is arranged a first cleansing liquid applicator unit $U_2$ having a construction which will now be described with particular reference to FIGS. 1, 3 and 4.

Referring now to FIGS. 1, 3 and 4, the first cleansing liquid applicator unit $U_2$ comprises a curved support block 30 having one side rigidly secured to the upright support 10 and is so curved as to follow the curvature of the rotary drum 17. The support block 30 has a plurality of parallel rows, preferably three rows, of nozzles 30*a*, 30*b* and 30*c* each row extending in the circumferential direction of said drum 17. Each row of nozzles 30*a*, 30*b* or 30*c* extends through a predetermined angle on both sides of the vertical line passing through the axis of said shaft 21. The nozzles of the rows 30*a*, 30*b* and 30*c* are communicated to a source of cleansing liquid under pressure by means of a passage 30*d* formed in the block 30, which passage 30*d* is in turn connected to a passage formed in the upright support 10. As best shown in FIG. 4, the intermediate row of nozzles 30*b* is so directed as to face the plugs, transported in a manner as will be described later, in alignment with the center of the closure body C, while the outer and inner rows of nozzles 30*a* and 30*c* are preferably oriented towards the center of the closure body C so that cleansing liquid sprayed under pressure from the nozzles of these rows 30*a*, 30*b* and 30*c* can be centered on the plugs being successively transported past the first cleansing station, establishing the pattern of distribution of cleansing liquid as shown in FIG. 4. However, depending upon the size and/or shape of the plugs or closures to be cleansed, the number of rows of nozzles for one row of the receptacles 17*a* on the first rotary drum 17 need not always be limited to three such as shown in FIG. 3, but may be one, two or more than three.

At a second cleansing station for the second rotary drum 18, a second cleansing liquid applicator unit $U_3$ is positioned immediately above the second rotary drum 18 and extends through a predetermined angle on both sides of the vertical line passing through the axis of the shaft 22 at right angles to the latter. Since the second cleansing liquid applicator unit $U_3$ has the same construction as the first cleansing liquid applicator unit $U_2$, elements of the unit $U_3$ which are like the elements of the unit $U_2$ are designated by the identical reference numerals used to designate such elements of the unit $U_2$.

Referring particularly to FIG. 1, the groove 11b in the presser plate 11 extends a distance corresponding to the angular distance between the supply station and the transfer station. Specifically, while the recess 11*c* in the presser plate 11 is positioned in exact alignment with the transfer station where the plugs transported by the first rotary drum 17 are successively transferred onto a corresponding one of the receptacles on the second rotary drum 18 in a manner as will be described later, the groove 11b has one end situated in alignment with the supply station and the other end situated preceding and spaced a slight distance from the recess 11c, a substantially intermediate portion thereof angularly passing the first cleansing station.

On the other hand, the groove 12a in the presser plate 12 has one end situated in alignment with the transfer station which is located on the horizontal line passing through both the axis of the shaft 21 and that of the shaft 22 at right angles to the axes of said shafts 21 and 22 and where the annular end face of the receptacles on either the first or second rotary drums 17 and 18 is spaced at a minimum distance from the annular end face of one of the receptacles on the other of the first and second rotary drums 17 and 18. The other end of said groove 12 is spaced a slight distance from and preceding the recess 12b which is located at a release station following the second cleansing station where the second cleansing liquid applicator unit $U_3$ is positioned, a substantially intermediate portion of said groove 12a extending angularly past the second cleansing station in parallel relation to the direction of rotation of the second rotary drum 18.

The machine having the construction thus far described is satisfactory if only automation of the closure cleansing is desired. In view of this, the operation of the machine of the construction thus far described will be now described.

Assuming that the first and second rotary drums 17 and 18 are rotated about the shafts 21 and 22 in the opposite directions to each other, that is, clockwise and counterclockwise as viewed in FIG. 1, respectively, the receptacles 17a on the first rotary drum 17 as they successively pass the supply station become successively communicated to the vacuum source 26 through the groove 11b by way of the L-shaped passages 17b in the rotary drum 17. Simultaneously with the start of successive communication of the receptacles 17a to the vacuum source 26, the plugs which have been fed into the chute 29 after having been aligned with the annular leg L facing the chute 29 are successively mounted in the corresponding receptacles 17a on the first rotary drum 17. More specifically, since the receptacles 17a are communicated to the vacuum source 26 as hereinbefore described, the plugs mounted in the receptacles 17a are held by suction in such a manner that, as substantially shown in FIG. 4, the annular flange portion of the closure body C externally of the annular leg L rests on the annular end face 17h while the annular leg L is accommodated within the circular recess 17f.

The plugs thus held by suction in the respective receptacles 17a on the first rotary drum 17 are then transported towards the transfer station past the first cleansing station during continued rotation of the first rotary drum 17.

During successive passage of the plugs carried by the first rotary drum 17 in the manner as hereinabove described, a cleansing liquid is sprayed under high pressure from the individual nozzles of the first cleansing liquid applicator unit $U_2$. Although the pressure of the cleansing liquid sprayed from the nozzles towards the plugs varies depending upon various parameters, such as the spacing between the nozzle tip and the plug on the receptacle the velocity of movement of the plugs past the cleansing station, the type of the plugs to be cleansing and others, these parameters are preferably so selected that, where the plugs being cleansed are made of rubber material, the surface of the plugs facing the nozzles is elastically deformed by the sprayed cleansing liquid impinging upon said plug surface.

As the plugs successively pass the cleansing station while being transported by the first rotary drum 17, it is clear that the surface, including a peripheral face, of the closure body C of the plugs is cleansed. It is to be noted that each of the plugs held by suction in the associated receptacles 17a on the first rotary drum 17 is so spaced from the outer peripheral surface of said rotary drum 17 that the possibility of separation of the plug from the receptacle by the action of the splashing of cleansing liquid coming from the outer peripheral surface is substantially eliminated.

As the plugs on the receptacles 17a successively approach the transfer station during the further continued rotation of the first rotary drum 17, the receptacles 17a with the plugs thereon successively communicate with the compressed air source 27 in a similar manner to the communication between them and the vacuum source 26. Upon successive communication between the receptacles and the compressed air source 27 at the transfer station, the plugs transported by the first rotary drum 17 are expelled one at a time towards the second rotary drum 18, particularly, onto the receptacles 18a on the second rotary drum 18 which are then communicated with the vacuum source 26 through the groove 12a in the presser plate 12. Specifically, at the transfer station, each plug in a receptacle 17a on the first rotary drum 17 is expelled from the corresponding receptacle 17a by the action of the compressed air flowing through the associated L-shaped passage 17b on one hand and the expelled plug is sucked onto one of the receptacles 18a on the second rotary drum 18 then communicated with the vacuum source 26 on the other hand. As best shown in FIG. 5, each of the plugs successively transferred onto the associated receptacles 18a on the second rotary drum 18 assumes a position such that the surface of the closure body C opposite to the annular leg L rests on the annular end face of the receptacle 18a while the annular leg L projects radially outwards away from the second rotary drum 18. In other words, each of the plugs transferred has the position thereof reversed so that the surface of the closure body C, including the annular leg L, which has not been cleansed during the transportation thereof past the first cleansing station, is cleansed at the second cleansing station.

After the plugs have been successively transferred onto the receptacles on the second rotary drum and subsequently past the second cleansing station, the plugs are transported towards the release station at which the receptacles 18a having plugs held thereon by suction are successively communicated with the compressed air source 27 through the recess 12b. Upon communication of the receptacles 18a on the second rotary drum 18 with the compressed air source 27, the plugs are successively ejected from such receptacles 18a to the subsequent processing station which, in the instance as shown, is a silicone coating station, but which may be constituted by a storage container or a guide chute leading to any known automatic capping machine.

While the machine having the construction thus far described operates in the manner as hereinbefore described, the third and fourth rotary drums 19 and 20 constitute a silicone applying unit for applying a silicone resin coating to the individual plugs which have been completely cleansed.

Referring to FIG. 1, positioned below the third rotary drum 19 is a silicone bath 31 containing therein a silicone resin coating solution. The position of the surface level of the silicone resin solution within the silicone bath 31 is so selected that the cleansed plugs, which have been successively transferred at the release station onto the receptacles 19*a* on the third rotary drum 19 from the second rotary drum 18 in a manner substantially similar to the transfer of the plugs from the receptacles 19*a* on the first rotary drum 17 onto the receptacles 18*a* on the second rotary drum 18, will be completely immersed in the coating solution within the bath 31. For this purpose, the silicone bath 31 preferably has a construction wherein the coating solution is continuously or intermittently supplied into the bath 31 from a source of the solution through an inlet passage 31*a* to compensate for any possible reduction in the surface level of the solution within said bath 31.

While the purpose for which the silicone resin coating is applied to the plugs is well known to those skilled in the art, it may be sufficient to apply the silicone resin coating only to a surface area of the individual plugs other than the area thereof which contacts, for example, a medical solution contained in such bottles to be closed with the plugs. For this purpose, as hereinbefore described and as best shown in FIG. 6, the circular recess 19*f* in each of the receptacles 19*a* on the third rotary drum 19 has a depth less than the height of the annular leg L of the plugs to be silicone-coated so that the annular surface portion of the closure body C externally of the annular leg L is, when the cleansed plugs are respectively sucked onto the receptacles 19*a* on the second rotary drum 19, spaced a distance from the annular end face of the receptacles 19*a* while the external surface at that end of the annular leg L adjacent the closure body C is exposed from the recess 19*f* outwardly.

It will readily be seen that the plugs successively transferred from the receptacles 18*a* on the second rotary drum 18 into the corresponding receptacles 19*a* on the third rotary drum 19 at the release station are, while they are transported by the third rotary drum 19 with the receptacles 19*a* being in communication with the vacuum source 26 through the groove 13*a* in the presser plate 13, successively immersed in the silicone bath 31 and, thereafter, transported towards an additional transfer station where the receptacles 19*a*, which have been in communication with the vacuum source 26, are communicated to the compressed air source 27 through the recess 13*b* in the presser plate 13.

It is to be noted that transfer of each of the plugs from the receptacles 18*a* into the receptacles 19*a* at the release station takes place in such a manner that the annular leg L protruding outwardly away from the corresponding receptacle 18*a* on the second rotary drum 18 while the surface of the closure body C opposed to said annular leg L rests on the annular end face 18*h* of the corresponding receptacle 18*a* on the second rotary drum 18 is, upon simultaneous communication between such receptacle 18*a* and the compressed air source 27 and between such receptacle 19*a* and the vacuum source 26, engaged in the recess 19*f* in such receptacle 19*a* and held by suction in such receptacle 19*a* in a manner substantially as shown in FIG. 6.

Therefore, it is clear that each of the plugs transported by the third rotary drum 19 after having been moved past the silicone coating station, is transferred onto the receptacle 20*a* on the fourth rotary drum 20 at the additional transfer station in a manner similar to the transfer of the plugs from the receptacles 17*a* on the first rotary drum 17 onto the receptacles 18*a* on the second rotary drum 18 at the first mentioned transfer station. At this time, the recess 13*b* in the presser plate 13 is communicated with the compressed air source 27 while one end of the groove 14*a* in the presser plate 14 is communicated with the vacuum source 26.

Positioned above the fourth rotary drum 20 is a nozzle 32 supported in a manner similar to the cleansing unit $U_3$ for applying a cleansing liquid into the space in each of the plugs which is defined by the annular leg L and a portion of the surface of the closure body C surrounded by said annular leg L.

The fourth rotary drum 20 is so designed that the plugs successively transferred from the receptacles 19*a* on the third rotary drum 19 onto the corresponding receptacles 20*a* on the fourth rotary drum 20 at the third mentioned transfer station can be transported towards an ejection station where the cleansed and then silicone-coated plugs are successively ejected from the machine. It is to be noted that the ejection station corresponds to the position of the recess 14*b* in the presser plate 14 which is communicated with the compressed air source 27 for forcibly ejecting the plugs supported on the associated receptacles 20*a* on the fourth rotary drum 20.

With the machine constructed as hereinbefore fully described, it is clear that the closure members can be automatically cleansed and then have silicone applied thereto. It is to be noted that when the supply station is positioned immediately above the first rotary drum 17 such as shown and, at such supply station, each of the plugs is supplied into the corresponding receptacle 17*a* on the first rotary drum 17 with the annular leg L first engaged in the recess 17*f*, the trailing end of the groove 11*b* in the presser plate 11 may be positioned at a point spaced about 45° from the vertical line in the direction of rotation of the first rotary drum 17.

While in the foregoing embodiment the rotary carriers have been described as constituted by the first to fourth rotary drums 17 to 20, the rotary carriers may be constituted by discs supported for rotation in the horizontal plane about respective, vertically extending axes of rotation thereof. This example will now be described with particular reference to FIG. 7 in which only two discs are illustrated in operatively associated relation to each other.

Figure 7:
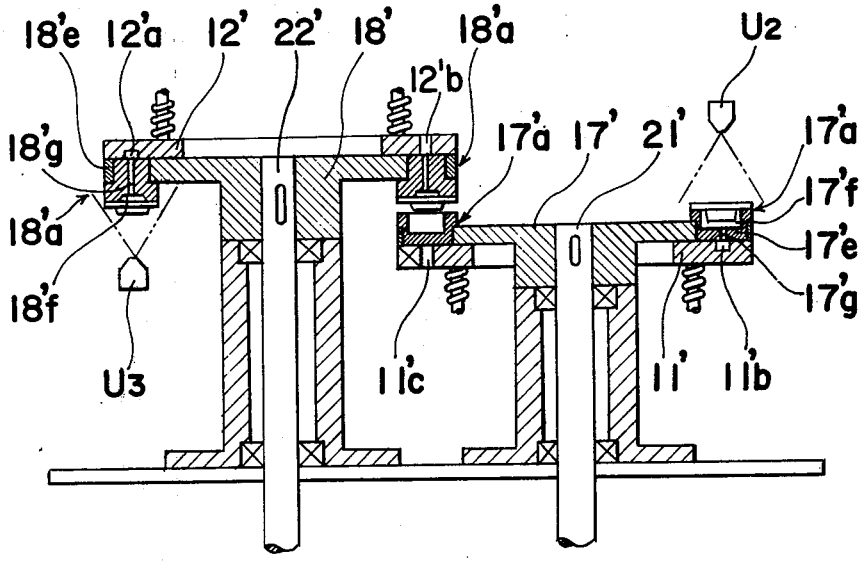
FIG. 7 is a schematic side sectional view of an automatic closure cleansing machine according to another preferred embodiment of the present invention.

Referring now to FIG. 7, two of the rotary carriers which functionally correspond to the first and second rotary drums 17 and 18, respectively, shown and described with reference to FIGS. 1 to 3, are shown to be comprised of first and second discs 17' and 18' respectively supported on vertical shafts 21' and 22' for rotation together therewith in the horizontal plane in the opposite directions to each other.

The first disc 17' has on the upper surface a plurality of receptacles 17'*a* arranged in circumferentially equally spaced relation to each other and also in radially equally spaced relation to the axis of the shaft 21'. Each of the receptacles 17'*a* comprises a cylindrical body 17'*e* having one end tapped into, or otherwise integrally formed with or secured to, the disc 17' and the other end having an inwardly extending circular recess 17'*f*, the bottom of said recess 17'*f* being adapted to be selectively communicated by a passage 17'*g* with the vacuum source 26 (FIG. 1) and the compressed air source 27 (FIG. 1) respectively through a curved groove 11'*b* and a recess 11'*c* which are formed in a presser plate 11' in a manner similar to the groove 11*b* and the recess 11*c* in groove 11b has one end situated in alignment with the supply station and the other end situated preceding and spaced a slight distance from the recess 11c, a substantially intermediate portion thereof angularly passing the first cleansing station.

On the other hand, the groove 12a in the presser plate 12 has one end situated in alignment with the transfer station which is located on the horizontal line passing through both the axis of the shaft 21 and that of the shaft 22 at right angles to the axes of said shafts 21 and 22 and where the annular end face of the receptacles on either the first or second rotary drums 17 and 18 is spaced at a minimum distance from the annular end face of one of the receptacles on the other of the first and second rotary drums 17 and 18. The other end of said groove 12 is spaced a slight distance from and preceding the recess 12b which is located at a release station following the second cleansing station where the second cleansing liquid applicator unit $U_3$ is positioned, a substantially intermediate portion of said groove 12a extending angularly past the second cleansing station in parallel relation to the direction of rotation of the second rotary drum 18.

The machine having the construction thus far described is satisfactory if only automation of the closure cleansing is desired. In view of this, the operation of the machine of the construction thus far described will be now described.

Assuming that the first and second rotary drums 17 and 18 are rotated about the shafts 21 and 22 in the opposite directions to each other, that is, clockwise and counterclockwise as viewed in FIG. 1, respectively, the receptacles 17a on the first rotary drum 17 as they successively pass the supply station become successively communicated to the vacuum source 26 through the groove 11b by way of the L-shaped passages 17b in the rotary drum 17. Simultaneously with the start of successive communication of the receptacles 17a to the vacuum source 26, the plugs which have been fed into the chute 29 after having been aligned with the annular leg L facing the chute 29 are successively mounted in the corresponding receptacles 17a on the first rotary drum 17. More specifically, since the receptacles 17a are communicated to the vacuum source 26 as hereinbefore described, the plugs mounted in the receptacles 17a are held by suction in such a manner that, as substantially shown in FIG. 4, the annular flange portion of the closure body C externally of the annular leg L rests on the annular end face 17h while the annular leg L is accommodated within the circular recess 17f.

The plugs thus held by suction in the respective receptacles 17a on the first rotary drum 17 are then transported towards the transfer station past the first cleansing station during continued rotation of the first rotary drum 17.

During successive passage of the plugs carried by the first rotary drum 17 in the manner as hereinabove described, a cleansing liquid is sprayed under high pressure from the individual nozzles of the first cleansing liquid applicator unit $U_2$. Although the pressure of the cleansing liquid sprayed from the nozzles towards the plugs varies depending upon various parameters, such as the spacing between the nozzle tip and the plug on the receptacle the velocity of movement of the plugs past the cleansing station, the type of the plugs to be cleansing and others, these parameters are preferably so selected that, where the plugs being cleansed are made of rubber material, the surface of the plugs facing the nozzles is elastically deformed by the sprayed cleansing liquid impinging upon said plug surface.

As the plugs successively pass the cleansing station while being transported by the first rotary drum 17, it is clear that the surface, including a peripheral face, of the closure body C of the plugs is cleansed. It is to be noted that each of the plugs held by suction in the associated receptacles 17a on the first rotary drum 17 is so spaced from the outer peripheral surface of said rotary drum 17 that the possibility of separation of the plug from the receptacle by the action of the splashing of cleansing liquid coming from the outer peripheral surface is substantially eliminated.

As the plugs on the receptacles 17a successively approach the transfer station during the further continued rotation of the first rotary drum 17, the receptacles 17a with the plugs thereon successively communicate with the compressed air source 27 in a similar manner to the communication between them and the vacuum source 26. Upon successive communication between the receptacles and the compressed air source 27 at the transfer station, the plugs transported by the first rotary drum 17 are expelled one at a time towards the second rotary drum 18, particularly, onto the receptacles 18a on the second rotary drum 18 which are then communicated with the vacuum source 26 through the groove 12a in the presser plate 12. Specifically, at the transfer station, each plug in a receptacle 17a on the first rotary drum 17 is expelled from the corresponding receptacle 17a by the action of the compressed air flowing through the associated L-shaped passage 17b on one hand and the expelled plug is sucked onto one of the receptacles 18a on the second rotary drum 18 then communicated with the vacuum source 26 on the other hand. As best shown in FIG. 5, each of the plugs successively transferred onto the associated receptacles 18a on the second rotary drum 18 assumes a position such that the surface of the closure body C opposite to the annular leg L rests on the annular end face of the receptacle 18a while the annular leg L projects radially outwards away from the second rotary drum 18. In other words, each of the plugs transferred has the position thereof reversed so that the surface of the closure body C, including the annular leg L, which has not been cleansed during the transportation thereof past the first cleansing station, is cleansed at the second cleansing station.

After the plugs have been successively transferred onto the receptacles on the second rotary drum and subsequently past the second cleansing station, the plugs are transported towards the release station at which the receptacles 18a having plugs held thereon by suction are successively communicated with the compressed air source 27 through the recess 12b. Upon communication of the receptacles 18a on the second rotary drum 18 with the compressed air source 27, the plugs are successively ejected from such receptacles 18a to the subsequent processing station which, in the instance as shown, is a silicone coating station, but which may be constituted by a storage container or a guide chute leading to any known automatic capping machine.

While the machine having the construction thus far described operates in the manner as hereinbefore described, the third and fourth rotary drums 19 and 20 constitute a silicone applying unit for applying a silicone resin coating to the individual plugs which have been completely cleansed.

Referring to FIG. 1, positioned below the third rotary drum 19 is a silicone bath 31 containing therein a silicone resin coating solution. The position of the surface level of the silicone resin solution within the silicone bath 31 is so selected that the cleansed plugs, which have been successively transferred at the release station onto the receptacles 19*a* on the third rotary drum 19 from the second rotary drum 18 in a manner substantially similar to the transfer of the plugs from the receptacles 19*a* on the first rotary drum 17 onto the receptacles 18*a* on the second rotary drum 18, will be completely immersed in the coating solution within the bath 31. For this purpose, the silicone bath 31 preferably has a construction wherein the coating solution is continuously or intermittently supplied into the bath 31 from a source of the solution through an inlet passage 31*a* to compensate for any possible reduction in the surface level of the solution within said bath 31.

While the purpose for which the silicone resin coating is applied to the plugs is well known to those skilled in the art, it may be sufficient to apply the silicone resin coating only to a surface area of the individual plugs other than the area thereof which contacts, for example, a medical solution contained in such bottles to be closed with the plugs. For this purpose, as hereinbefore described and as best shown in FIG. 6, the circular recess 19*f* in each of the receptacles 19*a* on the third rotary drum 19 has a depth less than the height of the annular leg L of the plugs to be silicone-coated so that the annular surface portion of the closure body C externally of the annular leg L is, when the cleansed plugs are respectively sucked onto the receptacles 19*a* on the second rotary drum 19, spaced a distance from the annular end face of the receptacles 19*a* while the external surface at that end of the annular leg L adjacent the closure body C is exposed from the recess 19*f* outwardly.

It will readily be seen that the plugs successively transferred from the receptacles 18*a* on the second rotary drum 18 into the corresponding receptacles 19*a* on the third rotary drum 19 at the release station are, while they are transported by the third rotary drum 19 with the receptacles 19*a* being in communication with the vacuum source 26 through the groove 13*a* in the presser plate 13, successively immersed in the silicone bath 31 and, thereafter, transported towards an additional transfer station where the receptacles 19*a*, which have been in communication with the vacuum source 26, are communicated to the compressed air source 27 through the recess 13*b* in the presser plate 13.

It is to be noted that transfer of each of the plugs from the receptacles 18*a* into the receptacles 19*a* at the release station takes place in such a manner that the annular leg L protruding outwardly away from the corresponding receptacle 18*a* on the second rotary drum 18 while the surface of the closure body C opposed to said annular leg L rests on the annular end face 18*h* of the corresponding receptacle 18*a* on the second rotary drum 18 is, upon simultaneous communication between such receptacle 18*a* and the compressed air source 27 and between such receptacle 19*a* and the vacuum source 26, engaged in the recess 19*f* in such receptacle 19*a* and held by suction in such receptacle 19*a* in a manner substantially as shown in FIG. 6.

Therefore, it is clear that each of the plugs transported by the third rotary drum 19 after having been moved past the silicone coating station, is transferred onto the receptacle 20*a* on the fourth rotary drum 20 at the additional transfer station in a manner similar to the transfer of the plugs from the receptacles 17*a* on the first rotary drum 17 onto the receptacles 18*a* on the second rotary drum 18 at the first mentioned transfer station. At this time, the recess 13*b* in the presser plate 13 is communicated with the compressed air source 27 while one end of the groove 14*a* in the presser plate 14 is communicated with the vacuum source 26.

Positioned above the fourth rotary drum 20 is a nozzle 32 supported in a manner similar to the cleansing unit $U_3$ for applying a cleansing liquid into the space in each of the plugs which is defined by the annular leg L and a portion of the surface of the closure body C surrounded by said annular leg L.

The fourth rotary drum 20 is so designed that the plugs successively transferred from the receptacles 19*a* on the third rotary drum 19 onto the corresponding receptacles 20*a* on the fourth rotary drum 20 at the third mentioned transfer station can be transported towards an ejection station where the cleansed and then silicone-coated plugs are successively ejected from the machine. It is to be noted that the ejection station corresponds to the position of the recess 14*b* in the presser plate 14 which is communicated with the compressed air source 27 for forcibly ejecting the plugs supported on the associated receptacles 20*a* on the fourth rotary drum 20.

With the machine constructed as hereinbefore fully described, it is clear that the closure members can be automatically cleansed and then have silicone applied thereto. It is to be noted that when the supply station is positioned immediately above the first rotary drum 17 such as shown and, at such supply station, each of the plugs is supplied into the corresponding receptacle 17*a* on the first rotary drum 17 with the annular leg L first engaged in the recess 17*f*, the trailing end of the groove 11*b* in the presser plate 11 may be positioned at a point spaced about 45° from the vertical line in the direction of rotation of the first rotary drum 17.

While in the foregoing embodiment the rotary carriers have been described as constituted by the first to fourth rotary drums 17 to 20, the rotary carriers may be constituted by discs supported for rotation in the horizontal plane about respective, vertically extending axes of rotation thereof. This example will now be described with particular reference to FIG. 7 in which only two discs are illustrated in operatively associated relation to each other.

Referring now to FIG. 7, two of the rotary carriers which functionally correspond to the first and second rotary drums 17 and 18, respectively, shown and described with reference to FIGS. 1 to 3, are shown to be comprised of first and second discs 17' and 18' respectively supported on vertical shafts 21' and 22' for rotation together therewith in the horizontal plane in the opposite directions to each other.

The first disc 17' has on the upper surface a plurality of receptacles 17'*a* arranged in circumferentially equally spaced relation to each other and also in radially equally spaced relation to the axis of the shaft 21'. Each of the receptacles 17'*a* comprises a cylindrical body 17'*e* having one end tapped into, or otherwise integrally formed with or secured to, the disc 17' and the other end having an inwardly extending circular recess 17'*f*, the bottom of said recess 17'*f* being adapted to be selectively communicated by a passage 17'*g* with the vacuum source 26 (FIG. 1) and the compressed air source 27 (FIG. 1) respectively through a curved groove 11'*b* and a recess 11'*c* which are formed in a presser plate 11' in a manner similar to the groove 11*b* and the recess 11*c* in the presser plate 11 in the earlier described embodiment. The presser plate 11' is supported below the disc 17' and telescopicallly biased against the opposed, lower surface of the first disc 11' in a manner similar to the presser plate 11 in the earlier described embodiment.

On the other hand, the second disc 18' has on the lower surface a plurality of receptacles 18'a, for example, equal in number to the number of the receptacles 17'a on the first rotary drum 17', arranged in circumferentially equally spaced relation to each other and also in radially equally spaced relation to the axis of the shaft 22'. Each of the receptacles 18'a comprises a cylindrical body 18'e having one end tapped into, or otherwise integrally formed with or secured to, the disc 18' and the other end having an inwardly extending circular recess 18'f, the inner end of said recess 18'f being adapted to be selectively communicated by a passage 18'g with the vacuum source 26 and the compressed air source 27 respectively through a curved groove 12'a and a recess 12'b which are formed in a presser plate 12' in a manner similar to the groove 12a and the recess 12b in the presser plate 12 of the earlier described embodiment. The presser plate 12' is supported above the disc 18' and telescopically biased against the opposed, upper surface of the disc 18' in a manner similar to the presser plate 12 in the earlier described embodiment.

While each of the first and second rotary discs 17' and 18' is constructed as hereinbefore described, these first and second discs 17' and 18' are so positioned that any one of the receptacles on either one of said first and second rotary discs 17' and 18' can be exactly aligned with one of the receptacles on the other of the first and second rotary discs 17' and 18' during the simultaneous rotation of said discs in the opposite directions while said discs 17' and 18' partially overlap with each other at their outer peripheral portions.

In the arrangement shown in FIG. 7, it is to be noted that the cleansing units $U_2$ and $U_3$ are required to be respectively positioned above and below the rotary discs 17' and 18'.

The machine constructed in accordance with the embodiment of FIG. 7 can, so far as closure cleansing is involved, operate in a manner substantially similar to the machine of the construction shown in FIGS. 1 to 3, but having only the first and second rotary drums 17 and 18. However, it is to be noted that, at the transfer station, each of the plugs transported by the first rotary disc 17' is shifted upwardly by the action of compressed air passing through the passage 17'g, which is then in communication with the compressed air source 27 through the recess 11'c in the presser plate 11', and on the other hand the upwardly shifted plug is sucked onto the corresponding receptacle 18'a on the second rotary disc 18' by the action of a sucking force developed in the passage 18'g then communicated with the vacuum source 26 through the groove 12'a in the presser plate 12'.

Although the present invention has fully been described in conjunction with the preferred embodiments thereof with reference to the accompanying drawings, it is to be noted that various changes and modifications will be apparent to those skilled in the art without departing from the true scope of the present invention. By way of example, the compressed air source 27 may not always be necessary, in which case the recesses 11c, 12b, 13b and 14b in the respective presser plates 11, 12, 13 and 14 or the recesses 11'c and 12'b in the respective presser plates 11' and 12' may be communicated with the atmosphere.

Furthermore, each of the passages 17b, 18b, 19b and 20b in respective rotary drums 17 to 20 or passages 17'e and 18'e in the respective discs 17' and 18' may be provided with a valve member for selectively closing and opening such passage for the purpose of prevention of reduction in efficiency of the vacuum source 26 which may otherwise take place when the passages and, therefore, the receptacles are communicated with the vacuum source if one or more of the receptacles have failed to receive corresponding closure members. In this case, an arrangement is necessary to make the valve member operable in response to a signal from a detecting device designed to detect the presence or absence of the closure members in the receptacles.

Therefore, such changes and modifications are to be construed as included within the true scope of the present invention unless they depart therefrom.

What is claimed is:

1. For cleaning closure members each comprised of a closure body having first and second surfaces opposed to each other and a leg extending outwardly from and substantially at right angles to the first surface of said closure body, an automatic closure cleansing machine which comprises, in combination:

a. a support structure;

b. a first rotary carrier supported by said support structure for rotation in one direction, said machine having a supply station, a first cleaning station and a transfer station past which said rotary carrier rotates in sequence, said first rotary carrier having a plurality of receptacles arranged in at least one circular row coaxial with the axis of rotation of said first rotary carrier and in equally circumferentially spaced relation to each other, each receptacle having a cylindrical body having one end connected to the rotary carrier and the other end spaced a distance from a surface of the rotary carrier and having an inwardly extending recess complementary in shape to the shape of the leg on each of the closure members, at least some of said receptacles on said first rotary carrier successively receiving closure members during each rotation of the rotary carrier for transportation of said closure members from the supply station towards the transfer station past the first cleansing station;

c. means including a supply chute and disposed adjacent the first rotary carrier at the supply station for accommodating a batch of the closure members and for aligning the closure members in a predetermined posture and then feeding said closure members into said receptacles on said first rotary carrier through said chute;

d. a second rotary carrier supported by said support structure for rotation in a direction opposite to the direction of rotation of said first rotary carrier, said second rotary carrier being positioned adjacent the first rotary carrier and being movable past the transfer station, said machine having a second cleansing station and a release station past which said second rotary carrier rotates sequentially following rotation past said transfer station during each rotation thereof, said second rotary carrier having a plurality of receptacles arranged in at least one circular row coaxial with the axis of rotation of the second rotary carrier, said receptacles on said second rotary carrier being so spaced equally from each other that, during rotation of said first and second rotary carriers in the opposite directions to each other, the receptacles on said first and second rotary carriers can be successively aligned with the receptacles on the other of said first and second rotary carriers, each receptacle having a cylindrical body having one end connected to the rotary carrier and the other end spaced a distance from a surface of the rotary carrier and having an inwardly extending recess complementary in shape to the shape of the leg on each of the closure members, at least some of said receptacles on said second rotary carrier, as they are moved past said transfer station during rotation of said second rotary carrier, receiving the closure members from the corresponding receptacles on said first rotary carrier and, thereafter, transporting said closure towards the release station;

e. first means operatively coupled to said first rotary carrier for continuously driving said first rotary carrier in said one direction;

f. second means operatively coupled to said second rotary carrier for driving said second rotary carrier in said direction opposite to the direction of rotation of the first rotary carrier in synchronism with said first rotary carrier;

g. a vacuum supplying means;

h. an air supplying means;

i. first means for communicating said some of said receptacles on said first rotary carrier to said vacuum supplying means during rotation of said first rotary carrier from said supply station at least past said first cleansing station for sucking closure members toward said some of said receptacles on said first rotary carrier;

j. second means for communicating said some of the receptacles on the first rotary carrier to said air supplying means at said transfer station;

k. third means for communicating some of the receptacles on the second rotary carrier to said vacuum supplying means during rotation of said second rotary carrier from said transfer station at least past said second cleansing station for sucking closure members toward said some of said receptacles on said second rotary carrier from said first rotary carrier;

l. fourth means for communicating said some of the receptacles on the second rotary carrier to said air supplying means at said release station for releasing closure members which have been transported to said release station from the transfer station past the second cleansing station by said second rotary carrier;

m. said first and second means for communicating and said third and fourth means for communicating being operatively associated and operated simultaneously during each rotation of the first and second rotary carriers, respectively;

n. a first cleansing liquid applicator positioned adjacent the first rotary carrier at the first cleansing station for spraying a cleansing liquid under pressure against one of the surfaces of the closure body of each of the closure members; and o. a second cleansing liquid applicator positioned adjacent the second rotary carrier at the second cleansing station for spraying a cleansing liquid under pressure against the other of the surfaces of the closure body of each of the closure members.

2. An automatic closure cleansing machine as claimed in claim 1, further comprising means for applying a silicone resin coating to the individual closure members which have been completely cleansed, said applying means being adjacent said second rotary carrier.

3. An automatic closure cleansing machine as claimed in claim 1, wherein each of the first and second rotary carriers is a cylindrical drum supported for rotation in the vertical plane; said receptacles being provided on the outer peripheral surface of said cylindrical drum and extending radially outwardly therefrom in circumferentially equally spaced relation to each other, said surface of the rotary carrier being said outer peripheral surface thereof.

4. An automatic closure cleansing machine as claimed in claim 3, further comprising means for applying a silicone resin coating to the individual closure members which have been completely cleansed, said applying means being adjacent said second rotary carrier.

5. For cleaning closure members each comprised of a closure body having first and second surfaces opposed to each other and a leg extending outwardly from and substantially at right angles to the first surface of said closure body, an automatic closure cleansing machine which comprises, in combination:

a. a support structure;

b. a first rotary drum rotatably carried by said support structure for rotation in one direction, said machine having a supply station, a first cleansing station and a transfer station past which said first rotary carrier rotates in sequence said first rotary drum having a plurality of support columns extending radially outwardly from the outer peripheral surface thereof in equally circumferentially spaced relation to each other, said support columns being in at least one circumferentially extending row coaxial with the axis of rotation of the first rotary drum, the free end of each of the support columns on the first rotary drum having a radially inwardly extending recess complementary in shape to the leg of the closure members to be cleansed;

c. said first rotary drum having a plurality of first passages therein equal in number to the number of the support columns on the first rotary drum, each of said passages having one end opening towards the associated recess in each of the support columns and the other end opening at one end free of the first rotary drum, said other ends of said passages being arranged in a circular pattern and equidistantly spaced from the axis of rotation of the first rotary drum;

d. means operatively coupled to said first rotary drum for continuously driving the first rotary drum in one direction;

e. means including a supply chute and disposed adjacent the first rotary drum at the supply station for accommodating therein a batch of the closure members and for aligning the closure members in a predetermined posture and then feeding said closure members successively onto said support columns on the first rotary drum through said chute;

f. a vacuum supplying means;

g. an air supplying means;

h. a first back-up plate supported by said support structure and yieldably urged toward said one end face of said first rotary drum for causing one surface thereof to relatively slidingly contact said one end face of the first rotary drum, said back-up plate having in said one surface thereof a curved groove communicating with said vacuum supplying means and an aperture communicating with said air supplying means, said groove and aperture being arranged in the order described in the direction of rotation of the first rotary drum and in alignment with the path of travel of the other open ends of the first passages;

i. a second rotary drum rotatably carried by said support structure for rotation in a direction opposite to the direction of rotation of the first rotary drum, said second rotary drum being positioned adjacent the first rotary drum and being movable past the transfer station, said machine having a second cleansing station and a release station past which said second rotary drum rotates sequentially following rotation past said transfer station during each rotation thereof, said second rotary drum having a plurality of support columns extending radially outwardly from the outer peripheral surface thereof in equally circumferentially spaced relation to each other, said support columns being in at least one circumferentially extending row coaxial with the axis of rotation of the second rotary drum, the free end of each of the support columns on the second rotary drum having a radially inwardly extending recess, said support columns on the second rotary drum being so spaced from each other that, during rotation of the first and second rotary drums in the opposite directions with respect to each other, the support columns on one of the rotary drums are successively aligned with the support columns on the other of the rotary drums, at least some of said support receptacles on the second rotary drum, as they are moved past said transfer station during rotation of said second rotary drum, receiving the closure members from the corresponding support columns on the first rotary drum and, thereafter, transporting said closure members towards the release station;

j. said second rotary drum having a plurality of second passages therein equal in number to the number of the support columns on the second rotary drum, each of said passages having one end opening towards the associated recess in each of the support columns and the other end opening at one end face of the second rotary drum, said other ends of said passages being arranged in a circular pattern and equidistantly spaced from the axis of rotation of the second rotary drum;

k. a second means operatively coupled to said second rotary drum for continuously driving the second rotary drum in a direction opposite to the direction of rotation of the first rotary drum;

l. a second back-up plate supported by said support structure and yieldably urged toward said one end face of said second rotary drum for causing one surface thereof to relatively slidingly contact said one end face of the second rotary drum, said back-up plate having in said one surface thereof a curved groove communicating with the vacuum supplying means and an aperture communicating with said air supplying means, said groove and aperture in said second back-up plate being arranged in the order described in the direction of rotation of the second rotary drum and in alignment with the path of travel of the other open ends of the second passages;

said curved groove in said first back-up plate extending from said supply station past said first cleansing station and said aperture being opposite said transfer station, whereby during each rotation of said first rotary drum, when said support columns on the first rotary drum are sucessively brought to the supply station, the recesses in said support columns on the first rotary drum are communicated to the vacuum supplying means through the groove in the first back-up plate to suck the closure members toward the recesses from the chute and hold them under suction, said recesses in said support columns on the first rotary drum with the closure members supported thereby being subsequently communicated with the air supplying means through said aperture in the first back-up plate to allow the closure members to be successively transferred onto the support columns on the second rotary drum at the transfer station; and said curved groove in said second back-up plate extending from said transfer station past said second cleansing station and said aperture being opposite said release station, whereby during each rotation of said second rotary drum in synchronism with the first rotary drum when said support columns on the second rotary drum are successively brought to the transfer station, the recesses in said support columns on the second rotary drum are communicated to the vacuum supplying means through the groove in the second back-up plate to suck the closure members from the support columns on the first rotary drum toward the recesses and hold them under suction, said recesses in said support columns on the second rotary drum with the transferred closure members supported thereby being subsequently communicated to the air supplying means to allow the closure members to be successively released from the support columns on the second rotary drum at said release station;

m. a first cleansing liquid applicator positioned adjacent the first rotary drum at the first cleansing station for spraying a cleansing liquid under pressure against one of the surfaces of the closure body of each of the closure members; and n. a second cleansing liquid applicator positoned adjacent the second rotary drum at the second cleansing station for spraying a cleansing liquid under pressure against the other of the surfaces of the closure body of each of the closure members.

6. An automatic closure cleansing machine as claimed in claim 5, further comprising means for applying a silicone resin coating to the individual closure members which have been completely cleansed and released from the second rotary drum at the release station, said applying means being adjacent said second rotary carrier.

7. An automatic closure cleansing machine as claimed in claim 6, wherein said air supplying means is a means for supplying compressed air.

8. An automatic closure cleansing machine as claimed in claim 5, wherein said air supplying means is a means for supplying compressed air.

* * * * *